US005298961A

United States Patent [19]

Tajima

[11] Patent Number: 5,298,961

[45] Date of Patent: Mar. 29, 1994

[54] IMAGE FORMING APPARATUS WITH PARALLEL EXPOSURE PROCESSING

[75] Inventor: Hatsuo Tajima, Matsudo, Japan

[73] Assignee: Canon Kabushiki Kaisha, Tokyo, Japan

[21] Appl. No.: 859,809

[22] Filed: Mar. 30, 1992

[30] Foreign Application Priority Data

Mar. 29, 1991 [JP] Japan ..... 3-89154

[51] Int. Cl.[5] ..... G03G 15/04; G03G 15/06; G03G 21/00

[52] U.S. Cl. ..... 355/202; 355/214; 355/246

[58] Field of Search ..... 355/202, 214, 246, 69

[56] References Cited

U.S. PATENT DOCUMENTS

| | | | |
|---|---|---|---|
| 4,256,401 | 3/1981 | Fujimura et al. | 355/214 |
| 4,588,283 | 5/1986 | Tokuhard | 355/214 |
| 4,607,954 | 8/1986 | Osaka et al. | 355/246 |
| 4,630,918 | 12/1986 | Yui et al. | 355/214 X |
| 4,657,377 | 4/1987 | Takahashi | 355/214 |
| 4,660,961 | 4/1987 | Kuramoto et al. | 355/202 |
| 4,831,418 | 5/1989 | Ito et al. | 355/69 |
| 4,994,827 | 2/1991 | Jamzadeh et al. | 355/326 X |
| 5,049,939 | 9/1991 | Koichi | 355/246 |
| 5,119,129 | 6/1992 | Setani | 355/202 |

FOREIGN PATENT DOCUMENTS 59-216166 12/1984 Japan .

*Primary Examiner*—Fred L. Braun

*Attorney, Agent, or Firm*—Fitzpatrick, Cella, Harper & Scinto

[57] ABSTRACT

An image forming apparatus includes an electrophotographic photosensitive member, a first optical device for forming a first electrostatic latent image on the photosensitive member, and a second optical device for forming a second electrostatic latent image on the photosensitive member. The first optical device includes a light source for illuminating an original to be recorded and a focusing optical system for projecting light reflected from the illuminated original onto the photosensitive member. The second optical device includes a modulated light emitting device for emitting modulated light in response to a record image signal and an optical device for exposing the modulated light onto the photosensitive member. A developer develops the first and second electrostatic latent images, an adjuster changes a luminous intensity of the light source to form the first electrostatic latent image and a controller controls a development bias voltage applied to the developer to develop the second electrostatic latent image in accordance with the change in the amount of luminous intensity of the light source.

7 Claims, 4 Drawing Sheets

IMAGE FORMING APPARATUS WITH PARALLEL EXPOSURE PROCESSING

BACKGROUND OF THE INVENTION

1. Field of the Invention

The present invention relates to an image forming apparatus comprising a first optical means for projecting a light image of an original to be copied on an electrophotographic photosensitive member, and a second optical means for illuminating light modulated in correspondence to an image signal onto the electrophotographic photosensitive member.

2. Related Background Art

There has been proposed a copying apparatus comprising an analogue exposure means (first optical means) for directly projecting an original image on a photosensitive member by means of an optical system including a light source such as a halogen lamp or a fluorescent lamp, reflection mirrors and optical lenses, and a digital exposure means (second optical means) for illuminating light onto the photosensitive member in response to a digital image signal by using a laser or an LED array as a light source. This copying apparatus was so designed that the digital exposure means removes the charge in a non-image area other than an original image (first image) area formed by the analogue exposure means and writes an additional information image (second image) on the first image.

The above digital exposure means can be utilized to copy color information defined within an area of the same or different original image encircled by a mark and the like, or to copy characters, figures, date or the like stored in the copying apparatus itself, or to copy information inputted from external equipments other than the copying apparatus through the communication. That is to say, when the image is written by the digital exposure means, the analogue exposure is partly shielded, and the shielded area is exposed by the modulated light by means of the digital exposure means with the background scan (scanning operation wherein the latent image charge in the non-image area is removed with remaining the latent image charge in the image area) to form an electrostatic latent image, and then the latent image is developed by a developing means to obtain a visualized image.

By the way, the sensitivity of the electrophotographic photosensitive member is varied by repeating the image forming operations. That is to say, for a long period of time, the potential (Vd) of a dark portion of the photosensitive member is decreased and the potential (V1) of a bright portion is increased. Further, during the continuous copying operation and the like, the potentials of the dark and bright portions are both reduced temporarily. For these reasons, the reduction in density of the copy image and(or) the fog of the copy image occur.

In order to solve these problems, an image forming apparatus may be so designed that the charging potential and(or) the exposure quantity are adjusted on the basis of an output signal from a sensor provided for measuring a surface potential of the photosensitive member. However, the apparatus having such potential measuring sensor requires the exclusive complicated control circuit, thus making the apparatus expensive.

Of course, the image forming processes may be manually adjusted individually without the provision of such control circuit; in this case, however, the adjusting operation will be complicated and troublesome.

SUMMARY OF THE INVENTION

An object of the present invention is to provide an image forming apparatus wherein both an image formed by a first optical means and an image formed by a second optical means have the good image qualities.

According to the present invention, there is provided an image forming apparatus comprising an adjusting means for changing the luminous intensity of an original lighting light source of a first optical means, and a control means for controlling a development bias voltage applied to a developing means for developing a second electrostatic latent image formed by a second optical means, in correspondence to the change in amount of the luminous intensity of the light source.

DETAILED DESCRIPTION OF THE PREFERRED EMBODIMENTS

The present invention will now be fully explained with reference to the accompanying drawings.

Figure 1:
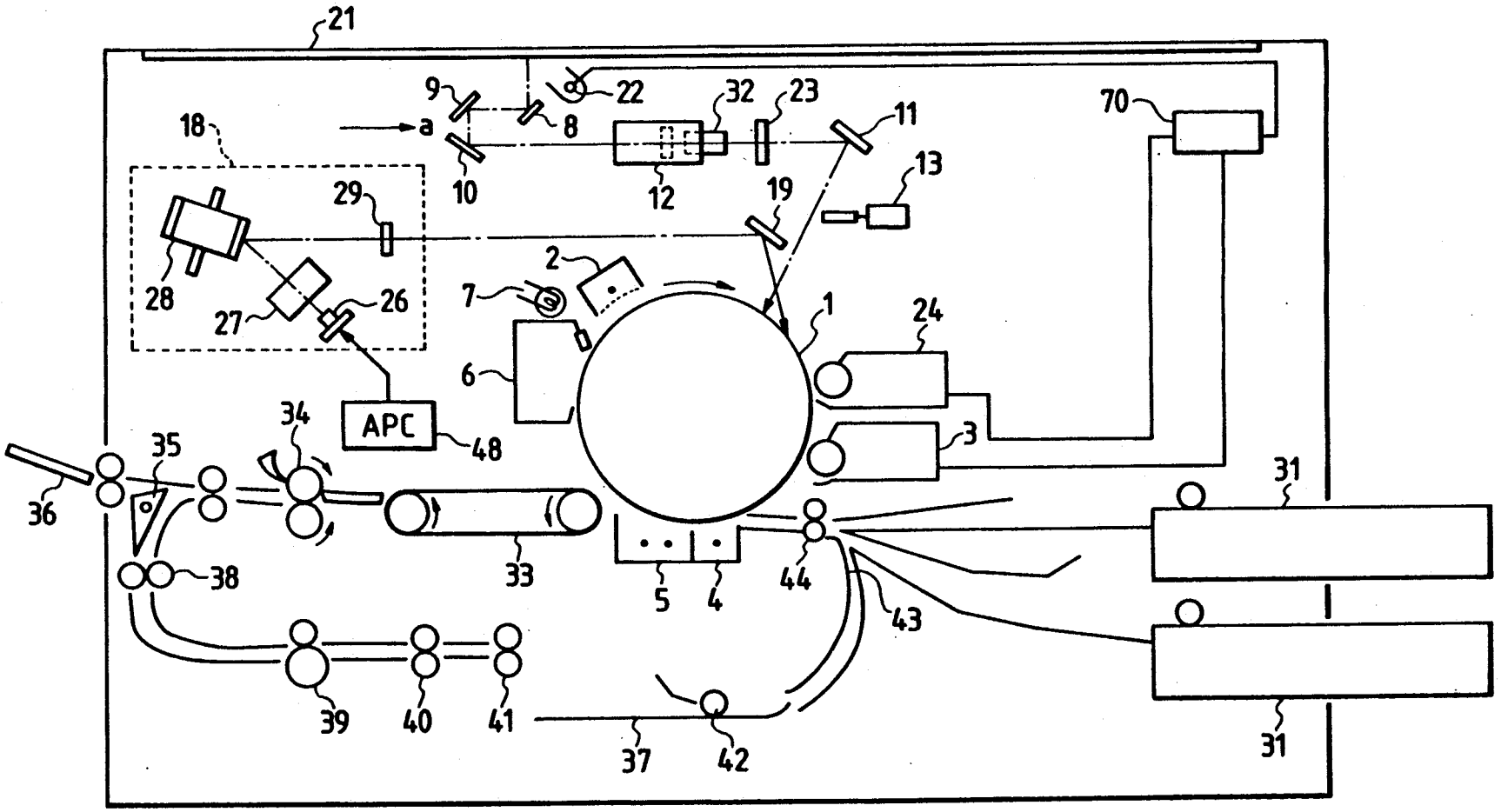
FIG. 1 is a schematic elevational sectional view of an image forming apparatus according to a first embodiment of the present invention.

In FIG. 1, an image forming apparatus includes an organic electrophotographic photosensitive member 1 constituted by sequentially coating a charge generating layer and a charge transfer layer on a surface of a cylindrical aluminum cylinder. Various means for forming an image by a conventional electrophotographic technique are disposed around the photosensitive member 1. Among these means, for example, a primary charger 2 serves to uniformly corona-charge the photosensitive member 1, an exposure means (described later) serves to form an electrostatic latent image on the photosensitive member 1, and a developing means 3 containing black toner therein or a developing device 24 containing color toner (for example, red toner) serves to visualize the latent image as a toner image. Further, a transfer charger 4 serves to transfer the toner image onto a transfer sheet fed from a sheet supply cassette 31 through resist, rollers 44, and a separating charger 5 serves to separate the transfer sheet to which the toner image was transferred from the photosensitive member 1. Then, the transfer sheet is fed, via a belt 33, to a fixing device 34, where the toner image is permanently fixed onto the transfer sheet. On the other hand, the residual toner remaining on the photosensitive member 1 is removed by a cleaner 6. Thereafter, the charges on the photosensitive member are uniformly erased by a preexposure lamp 7, and then the photosensitive member is again corona-charged by the primary charger 2.

The developing devices 3, and 24 develop the electrostatic latent image properly. That is to say, the toner is charged with the charging polarity opposite to that of the primary charger 2 and then is adhered to a dark potential area of the photosensitive member.

An original 21 to be copied is illuminated by a lamp 22. A reflected light reflected from the original 21 illuminated by the lamp 22 is projected on the photosensitive member 1 via an optical system comprising mirrors 8, 9, 10, 11 and a focusing lens 12, thus forming a light image of the original on the photosensitive member 1. In this way, a first electrostatic latent image is formed.

Incidentally, the lamp 22 and the mirrors 8, 9, 10 shift in a direction shown by the arrow a in synchronous with a rotational speed of the photosensitive member 1 to scan the original 21. Further, between the last mirror 11 and the photosensitive member 1, there is disposed a shutter 13 driven by a solenoid and the like to selectively shield the reflected light.

Figure 3:
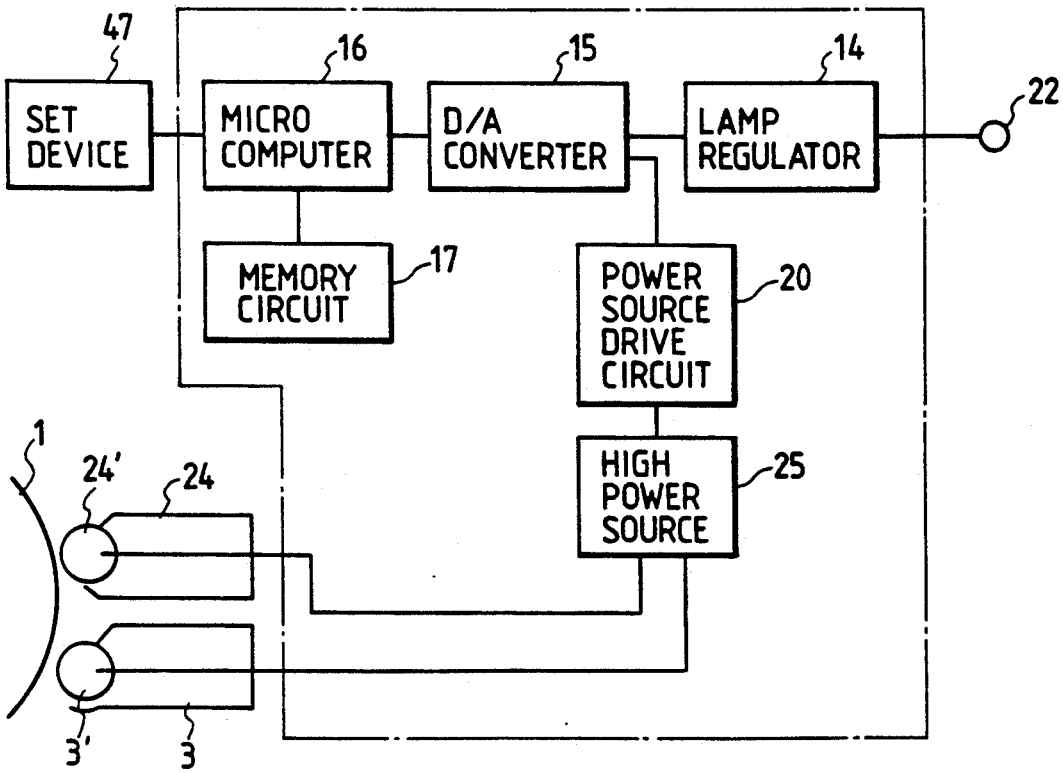
FIG. 3 is a block diagram for explaining a development bias control mechanism of the image forming apparatus of FIG. 1.

As shown in FIGS. 1 and 3, the lighting lamp 22 is connected to a lamp regulator 14 of a control device 70. The lamp regulator 14 is connected to a D/A converter 15, a microcomputer 16 and a set device 47. The set device 47 includes a variable resistor and the like therein and is manually operated by an operator. The microcomputer 16 controls an output of the lamp regulator 14 on the basis of a value set by the set device 47, thus controlling the luminous intensity (light amount) of the lamp 22.

On the other hand, a memory circuit connected to the microcomputer 16 stores the changed amount of the luminous intensity of the lamp 22 (changed amount of the driving current for the lamp 22) caused by the above-mentioned adjustment.

Further, the image forming apparatus also includes a second optical means 12 for performing the discharging operation for removing the charge from the surface of the photosensitive member 1 before and after the original image is exposed by the first optical means and for writing any characters, figures and the like in the copy image, which second optical means acts as a digital exposure means comprising a laser unit 18 and a mirror 19 for directing a laser beam to the photosensitive member 1.

The light beams emitted from a semi-conductor laser 26 of the laser unit 18 and modulated in response to a record signal are collimated by a collimator lens 27 and then are sent to a polygonal mirror 28. The beams reflected by the polygonal mirror are illuminated onto the photosensitive member 1 through an $f\theta$ lens 29 and a reflection mirror 19. In this way, the photosensitive member 1 is scanned by the laser beam to form a second electrostatic latent image thereon. The second latent image is also developed by the developing device 3 or 24 as mentioned above.

The light intensity of the laser 26 is controlled by an auto-power controller 48 for detecting the beam intensity and feeding back the detected beam intensity to the laser driving current. That is to say, even when the luminous intensity of the original lighting lamp 22 is altered, the light intensity of the laser 26 is always kept constant. In this way, the output of the laser is stabilized.

In the illustrated embodiment, the second optical means includes a uni-dimensional image sensor (CCD and the like) for reading the original 21 and for photoelectrically converting the read information into an electric signal.

Figure 2:
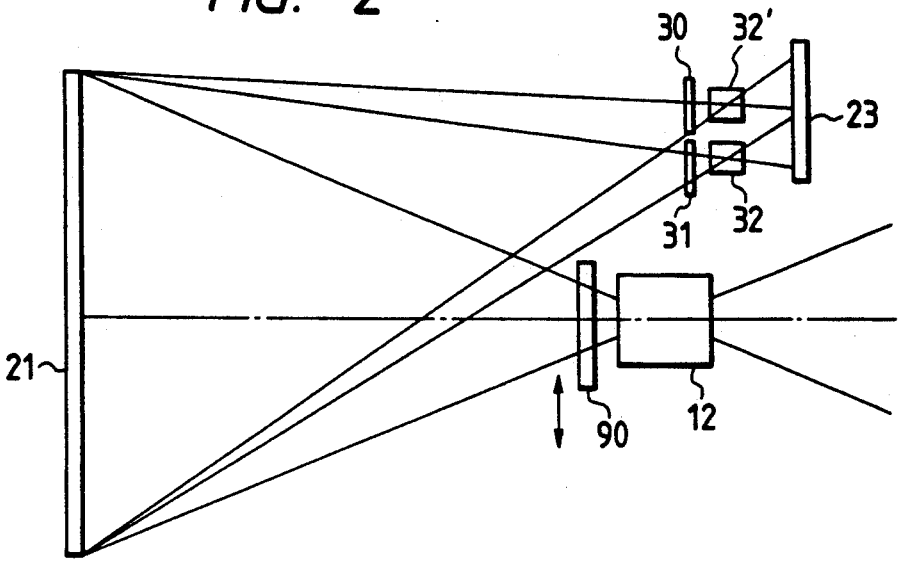
FIG. 2 is a plan view of a main portion of the image forming apparatus of FIG. 1.

More specifically, as shown in FIG. 2, the digital reading system comprises a blue color wavelength permeable filter 30, a red color wavelength permeable filter 31, two focusing lenses 32, 32' and a uni-dimensional image sensor 23 and cooperates with the lighting lamp 22 and the mirrors 8–10. The lenses 32, 32' are disposed behind the two filters, for example, the blue filter 30 and red filter 31 so that an blue image and an red image of the original 21 are focused on half areas of the uni-dimensional image sensor 23. Further, the reading unit and the first optical means are disposed side by side, thus preventing the mechanical interference therebetween. The original 21 is scanned and read line by line in synchronous with the scanning effected by means of the lamp 22 and the mirrors 8–12.

Now, as an example, it is assumed that an original 21 having a red image portion and the remaining black image portion is copied.

First of all, as shown in FIG. 2, by inserting a red filter 90 into a light path of the first optical means, the light image of the original 21 is projected onto the photosensitive member 1 by means of the first optical means. In this case, the lamp 22 emits the light with the luminous intensity set by the operator by using the set device 47.

That is to say, the black image portion of the original image cannot pass through the red filter 31, and, thus, the red image portion of the original image is illuminated on the photosensitive member 1. Therefore, a first latent image without the red image portion is formed on the photosensitive member, and is developed by the developing device 3. The developed image is transferred onto the transfer sheet by the transfer charger 4, thus obtaining the black image. Then, the transfer sheet to which the black image was transferred is sent to the fixing device 34 via the conveying belt 33. After the fixing, the transfer sheet is fed toward an intermediate tray 37 by a flapper 35.

Sheet feed rollers 38 to 41 send the transfer sheet on which the image was, fixed to the intermediate tray 37 by inverting the sheet (for multi-superimposed copy) or without inverting the sheet (both-sided copy). Re-supply rollers 42 feed the transfer sheet rested on the intermediate tray 37 up to the regist rollers 44.

Next, the image forming process for the red image portion of the original image is performed.

In this case, the lamp 22 emits the light with the predetermined light intensity other than the light intensity set by the set device 47, under the control of the microcomputer 16. In this way, the shading correction and alteration of the gain adjustment regarding the output signal of the image sensor 23 are not required.

Further, by inserting the shutter 13 in the light path of the first optical means, the light passed through the lens 12 is prevented from entering into the photosensitive member. In this case, by using the digital reading system, the red image portion of the original 21 is read by the sensor 23 via the red filter 31. The charge on the area of the photosensitive member corresponding to the black image portion of the original 21 is erased by the laser illumination from the second exposure means, and the area of the photosensitive member corresponding to the red image portion of the original 21 is exposed by the laser beam modulated in response to the output of the uni-dimensional image sensor 23, thus forming a second, electrostatic latent image. The second latent image is developed by the developing device 24 to form a red toner image.

The red toner image is transferred onto the transfer sheet fed from the intermediate tray 37 via the regist rollers 44, and the transfer sheet is sent to the fixing device 34, where the red toner image is fixed to the sheet. Thereafter, the transfer sheet on which the red toner image was fixed is ejected onto a tray 36.

Incidentally, the developing device 3, 24 have developing rollers 3', 24' for carrying the toner and supplying the toner to the photosensitive member 1, respectively. Each rollers 3', 24' faces the photosensitive member 1 and is subjected to the development bias voltage from a high voltage source 25. The development bias voltage causes the adequate amount of toner to adhere to the area having the dark portion potential (VD) and prevents the toner from adhering to the area having the bright portion potential (VL), thus avoiding the generation of the fog.

The reference luminous intensity of the lamp 22 and the reference luminous intensity of the laser 26 are stored in the memory circuit 17. Such reference luminous intensity is the intensity that it can provide a predetermined bright portion potential on the initial photosensitive member having the good sensitivity feature. For example, when the bright portion potential obtained by the exposure by means of the lighting lamp 22 is $VL_1$ and the bright portion potential obtained by the exposure by means of the laser unit 18 is $VL_2$, the luminous intensity of the lamp 22 and the luminous intensity of the laser 26 are previously set so that bright portion potentials $VL_1$, $VL_2$ become $-150$ V in comparison with the dark portion potential VD ($-650$ V) on the photosensitive member 1, and such set values are stored in the memory circuit 17.

When the exposure is effected under the condition so set, the first and second images having the high quality as mentioned above can be obtained. However, when such processes are repeated, the photosensitive layer of the photosensitive member 1 is subjected to the fatigue and the environmental change due to the repeated exposures, thus, decreasing the sensitivity of the photosensitive member 1, with the result that the proper images cannot be obtained under the initially set exposure condition. Of course, the luminous intensity (light amount) of the lighting lamp 22 and the luminous intensity of the laser 26 may be adjusted to provide the proper images. However, it is not preferable, since the individual adjustments are required and the luminous intensity of the laser 26 is preferably fixed to obtain the stable oscillation as mentioned above.

In the image forming apparatus so constructed, when the light amount of the lamp 22 of the analogue exposure means (first optical means) is adjusted, as the second latent image formed on the photosensitive member 1 by the digital exposure means (second optical means) with the predetermined light amount is developed, the desired development bias calculated by the microcomputer 16 on the basis of the adjustment of the light amount of the lamp 22 is applied to the developing device (developing device 3 or 24) via a power source drive circuit 20. In this way, the optimum development bias corresponding to the change in the potential of the first latent image due to the adjustment of the light amount of the lamp 22 is applied to the developing device (developing device 3 or 24) developing the second latent image via a high power source 25, so that the second latent image formed on the photosensitive member 1 by the digital exposure means with the predetermined light amount is visualized with the proper density as similar to the first latent image formed by the analogue exposure means.

Incidentally, the development bias voltage applied to the developing device (developing device 3 or 24) developing the first latent image is fixed to have a constant value, regardless of the change in the development bias voltage applied to the developing device developing the second latent image. The microcomputer 16 controls the drive circuit to achieve this.

Figure 4:
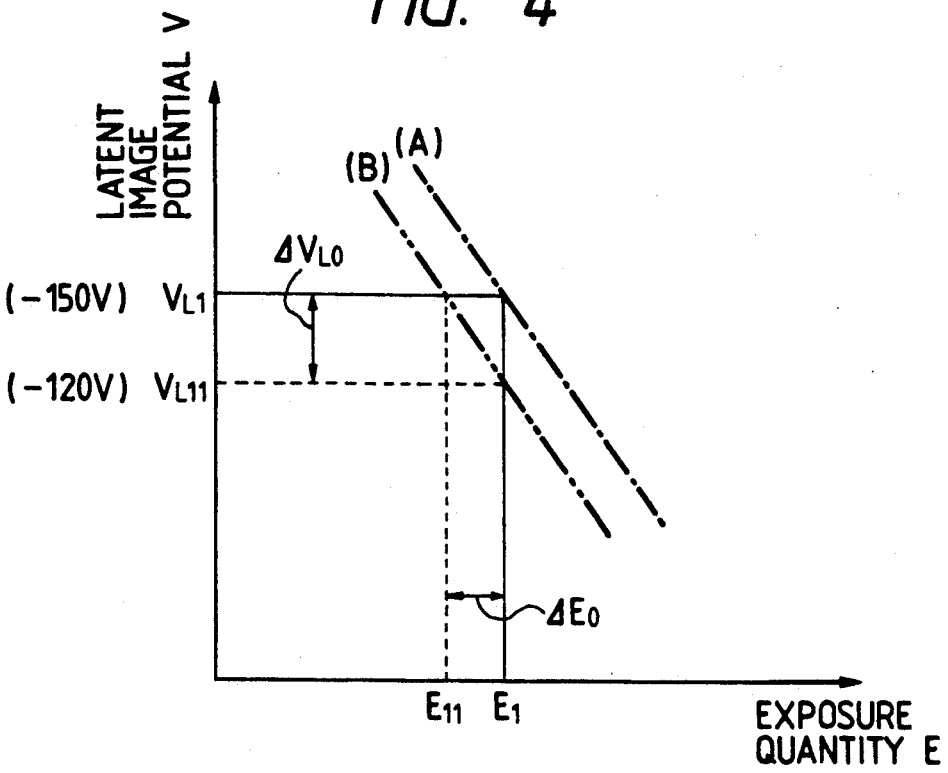
FIG. 4 is a graph showing the sensitivity feature of a photosensitive member of the image forming apparatus of FIG. 1.

Explaining more specifically, FIG. 4 is a graph showing the sensitivity feature of the photosensitive member 1 of FIG. 1, where the ordinate indicates the latent image potential (V). In FIG. 4, the feature (A) corresponds to the condition immediately after the copying operation is started, and the feature (B) corresponds to the condition after, for example, 100 sheets are copied.

As shown in FIG. 4, the latent image potential of the feature (A) is smaller than that of the feature (B) for the same exposure quantity E, and, for example, in the condition of the feature (A), the proper exposure quantity providing the proper bright portion potential $VL_1$ ($-150$ V) becomes $E_1$; whereas, in the condition of the feature (B), the bright portion potential becomes $VL_{11}$ ($-120$ V), and, thus, the proper exposure quantity for obtaining the proper bright portion potential $VL_1$ becomes $E_{11}$. Thus, the copied image becomes slightly lighter, thereby preventing the light color image portion of the original from being copied correctly. To avoid this, regarding the feature (B), by reducing the exposure quantity from $E_1$ to $E_{11}$ when the first latent image is formed by the first optical means, the proper bright portion potential $VL_1$ can be obtained. On the other hand, when the second latent image is formed by the second optical means, if the feature (B) is maintained, since the exposure quantity is not fixed to the value E1, the bright portion potential becomes $VL_{11}$ ($-120$ V). Thus, by applying the development bias voltage ($-190$ V) obtained by subtracting the difference (30 V) between the bright portion potential $VL_{11}$ and the proper bright portion potential $VL_1$ defined by the feature (A) from the proper development bias voltage Vdc (for example, $-22$ V) at the feature (A) to the developing device, it is possible to develop the second latent image with the proper density.

Incidentally, the above-mentioned proper development bias voltage, i.e., standard development bias voltage Vdc ($-220$ V) is applied to the developing device for developing the first latent image. Further, the subtraction of the above-mentioned difference from the proper development bias voltage means that the development bias voltage is changed from the proper development bias voltage toward a direction to which the bright portion potential is changed, by an absolute value of the difference.

Figure 5:
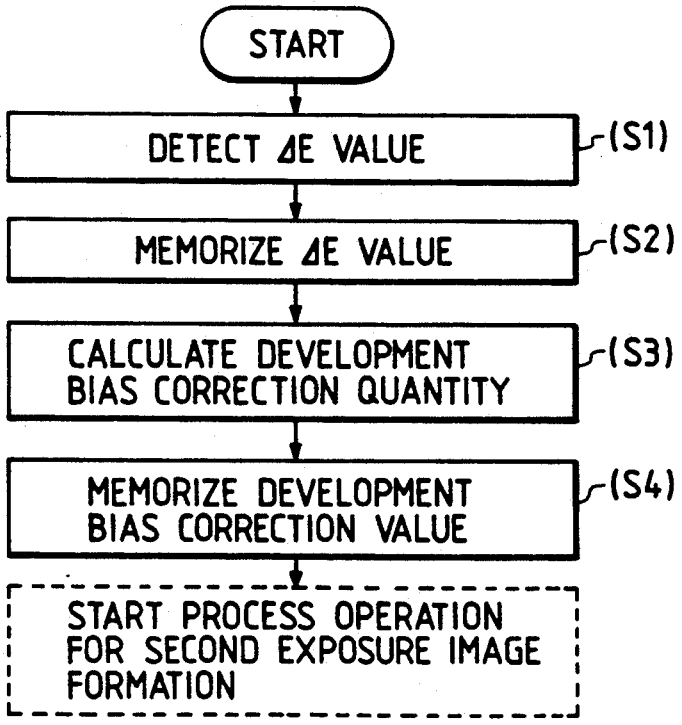
FIG. 5 is a flow chart showing an example of development bias correction processes, according to the image forming apparatus of the present invention.

A further detailed explanation will be continued with reference to a flow chart shown in FIG. 5. FIG. 5 is a flow chart showing an example of the development bias correcting procedure in the image forming apparatus according to the present invention. Incidentally, S1–S4 indicate steps.

First of all, a relation between the change amount $\Delta E_0$ between the luminous intensity ($E_{11}$) of the lamp 22 adjusted when the first latent image is formed by the first optical means and the standard luminous intensity ($E_1$), and the change amount $\Delta VL_0$ between the development bias value when the second latent image formed by the second optical means is developed and the standard development bias voltage Vdc is previously inputted to the memory circuit 17. Then, the change ΔE in the exposure quantity is detected (step S1) and this value is stored (step S2), and the development bias correction value is calculated on the basis of the following equation (1) (step S3). Then, the correction value is stored (step S4), and then the development bias voltage adjusted in correspondence to the correction value is applied to the developing device to start the image forming process.

Development Bias Voltage Correction Value=

$$\Delta E \times (\Delta VL_0/\Delta E_0) = \Delta E \times \alpha \quad (1)$$

Incidentally, a coefficient of correction $\alpha$ has the dispersion more or less for the photosensitive members, but can be indicated by substantially the same inclination in the vicinity of the proper bright portion potential of the latent image on the photosensitive member. Further, the change $\Delta E_0$ in the light quantity can be calculated by using the voltage applied from the lamp regulator 14 to the lighting lamp 22.

In this way, it is possible to prevent the possible fog of the first and second latent images and to obtain a good copy even when the original includes the light color image portion. Particularly, when it is desired to obtain the multi color combined image, it is possible to increase the copy speed.

In the illustrated embodiments, while the luminous intensity of the lamp 22 was manually adjusted, the apparatus may be so designed that there are provided a potential sensor for detecting the surface potential of the photosensitive member 1 and a white board arranged at the end of the original support glass plate, and by illuminating the white board with the standard light quantity by means of the lighting lamp 22 and by measuring the potential of the latent image formed on the photosensitive member 1 by means of the potential sensor by utilizing the reflected light from the white board, the light quantity $E_{11}$ corresponding to the proper bright portion potential $VL_1$ is determined to drive the lamp 22, and at the same time the change ΔE in the exposure quantity is detected.

In the first embodiment, while an example that the second optical means is used to reproduce a portion of the original image was explained, the present invention can be applied to a case where the second optical means forms a latent image corresponding to a desired digital image on the photosensitive member 1 on the basis of digital information corresponding to characters and the like previously registered in the image forming apparatus.

More particularly, the shutter 13 shown in FIG. 1 is driven at the predetermined timing to block a portion of the light reflected from the original 21, and a second latent image corresponding to data, characters, figures and the like is formed, as well as a first latent image corresponding to the image of the original, by illuminating the laser beam from the laser unit 18 onto the blocked area of the photosensitive member 1. Only while the second latent image formed by the illumination of the laser beam is being developed, the development bias voltage is corrected. In the above process, a single image forming process is effected, unlike to the first embodiment wherein an image forming process including two transfer steps is effected.

Further, in the illustrated embodiment, while the first and second latent images were developed by the discrete developing devices, these first and second latent images may be developed by the same developing device (3 or 24), particularly in the last-mentioned case.

Figure 6:
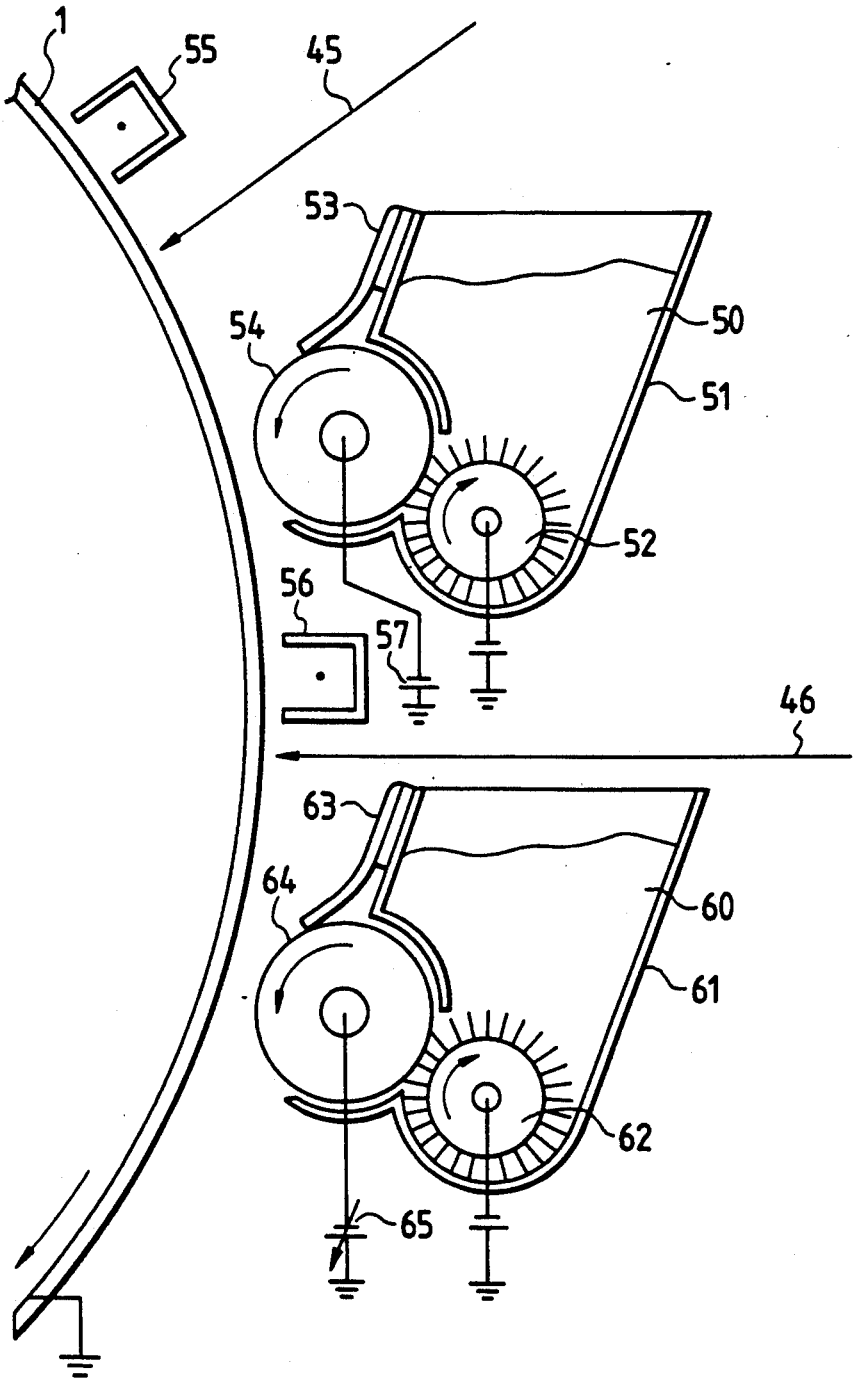
FIG. 6 is an elevational sectional view of a main portion of an image forming apparatus according to a second embodiment of the present invention.

FIG. 6 is an elevational sectional view of a main portion of an image forming apparatus according to the second embodiment of the present invention. In this embodiment, a plurality of developed images are overlappingly formed on a photosensitive member and these images are transferred onto a transfer sheet simultaneously with a single transfer process. To this end, in this embodiment, developing devices 51, 61 are arranged around a photosensitive member 1 so that, after a first developing operation (black color development), the re-charging of the photosensitive member and the second image exposure and development can be further continued. In this case, the reference numeral 45 denotes reflected light (first exposure light) relating to the analogue exposure means, which is comprised of the light reflected by the original as in the first embodiment; and 46 denotes light beam (second exposure light) relating to the digital exposure means, which is generated, for example, by a laser optical system and is focused on the photosensitive member via a scanning mirror system (not shown).

In this process, the photosensitive member 1 is uniformly charged by a first charger 55 and the first exposure light 45 as analogue exposure is illuminated on the photosensitive member to form a first latent image thereon, and the first latent image is developed by the developing device 51 disposed in the vicinity of the photosensitive member 1 and containing one-component black toner 50 therein. Then, the toner image on the photosensitive member 1 is charged by a second charger 56 and the second exposure light 46 as digital exposure is illuminated on the toner image on the photosensitive member to form a second latent image thereon, and the second latent image is developed by the developing device 61 disposed in the vicinity of the photosensitive member 1 and containing one-component red toner 60 therein. By repeating such charging, image exposure and development, plural color images are formed on the photosensitive member and are transferred onto the transfer sheet at a time.

Incidentally, the black toner 60 and the red toner 50 in the developing devices 51, 61 are supplied to developing sleeves 54, 64 by fur brushes 52, 62, respectively. The fur brushes 52, 62 serve to not only agitate the toner in the developing devices 51, 61, but also agitate the toner on the developing sleeves to prevent the so-called sleeve ghost. The developing sleeves 54, 64 are connected to develop bias sources, respectively, to form DC electric fields between the photosensitive member 1 and the developing sleeves. The toner on the developing sleeves is regulated by rubber blades 53, 63 to form a thin toner layer on the sleeves using the development.

A clearance between the photosensitive member 1 and each developing sleeve was selected to have a value of about 150 μm and a thickness of the toner layer on each developing sleeve was regulated to 30 μm, thus obtaining the triboelectric charge of the black toner 50 of 15 μcoul/g and the triboelectric charge of the red toner 60 of 10 μcoul/g.

In the image forming apparatus so constructed, when the parallel exposures regarding the photosensitive member 1 are started by the analogue exposure means (first optical means) and the digital exposure means (second optical means), a bias control means (microcomputer 16) controls to apply the desired development bias voltage calculated on the basis of the exposure quantity adjusting condition of the analogue exposure means to that developing means (developing device 61 in this embodiment) relating to the digital exposure means, thus visualizing the latent image formed on the photosensitive member 1 with the predetermined light quantity by means of the digital exposure means with the density level same as that of the latent image formed by the analogue exposure means.

The dark portion (no-image portion) potentials Vd of the first and second latent image are −600 V, the proper bright portion potential VL is −170 V, and the standard development bias voltages of −250 V are applied to the first and second developing devices 51, 61 from the development bias sources 57, 65, thus repeating the copying processes. Thereafter, when the sensitivity feature of the photosensitive member 1 is changed as shown in FIG. 4, the microcomputer 16 controls the development bias source 65 for the second developing device in response to the change in the exposure quantity adjusting value for the first image. In this way, it is possible to prevent the irregularity in each color and/or fog, thus obtaining the good color-combined image quickly.

What is claimed is:

1. An image forming apparatus comprising:

an electrophotographic photosensitive member;

first optical means for forming a first electrostatic latent image on said photosensitive member, said first optical means including a light source for illuminating an original to be recorded, and a focusing optical system for projecting light reflected from the original illuminated by said light source onto said photosensitive member;

second optical means for forming a second electrostatic latent image on said photosensitive member, said second optical means including modulated light emitting means for emitting light modulated in response to a record image signal, and optical means for exposing the modulated light on said photosensitive member;

developing means for developing the first and second electrostatic latent images;

adjusting means for changing a luminous intensity of the light source to form a first electrostatic latent image; and control means for controlling a development bias voltage applied to said developing means to develop the second electrostatic latent image, in correspondence to a change in amount of the luminous intensity of said light source, wherein a development bias voltage applied to said developing means to develop a first electrostatic latent image remains constant, regardless of the change in the development bias voltage for the second electrostatic latent image, and wherein intensity of the light emitted from said modulated light emitting means remains constant, regardless of the change in the luminous intensity of said light source.

2. An image forming apparatus according to claim 1, wherein said control means calculates said development bias voltage on the basis of the change in amount of the luminous intensity of said light source.

3. An image forming apparatus according to any one of claims 1 or 2, wherein said second optical means includes photoelectric converting means for receiving light reflected by the original illuminated by said light source to form said record image signal; and said light source illuminates the original with constant luminous intensity in the case said record image signal is formed, regardless of the luminous intensity when said first electrostatic latent image is formed.

4. An image forming apparatus according to claim 3, further including transfer means for transferring both a first image obtained by developing the first electrostatic latent image and a second image obtained by developing the second electrostatic latent image onto a single transfer sheet.

5. An image forming apparatus according to claim 4, wherein said developing means includes a first developing device for developing the first electrostatic latent image, and a second developing device for developing the second electrostatic latent image.

6. An image forming apparatus according to any one of claims 1 or 2, further including transfer means for transferring both a first image obtained by developing the first electrostatic latent image and a second image obtained by developing the second electrostatic latent image onto a single transfer sheet.

7. An image forming apparatus according to claim 6, wherein said developing means includes a first developing device for developing the first electrostatic latent image, and a second developing device for developing the second electrostatic latent image.

* * * * *

UNITED STATES PATENT AND TRADEMARK OFFICE

CERTIFICATE OF CORRECTION

PATENT NO. : 5,298,961

DATED : March 29, 1994

INVENTOR(S) : Hatsuo Tajima

It is certified that error appears in the above-indentified patent and that said Letters Patent is hereby corrected as shown below:

ON THE COVER

Under [56] References Cited,
"4,588,283 5/1986 Tokuhard" should read
--4,588,283 5/1986 Tokuhara--.

COLUMN 1

Line 51, "(vd)" should read --(VD)--; and
Line 53, "(V1)" should read --(VL)--.

COLUMN 4

Line 17, "mirrors 8-12" should read --mirrors 8-11--; and
Line 46, "regist" should read --resist--.

COLUMN 5

Line 4, "regist" should read --resist--; and
Line 9, "device 3,24" should read --devices 3 and 24--.

UNITED STATES PATENT AND TRADEMARK OFFICE

CERTIFICATE OF CORRECTION

PATENT NO. : 5,298,961

DATED : March 29, 1994

INVENTOR(S) : Hatsuo Tajima

It is certified that error appears in the above-identified patent and that said Letters Patent is hereby corrected as shown below:

COLUMN 6

Line 44, "—22V)" should read -- —220V)--.

Signed and Sealed this

Thirtieth Day of May, 1995

Bruce Lehman

*Attest:*

BRUCE LEHMAN

*Attesting Officer*

*Commissioner of Patents and Trademarks*